United States Patent [19]

Kobayashi

[11] Patent Number: 4,852,880

[45] Date of Patent: Aug. 1, 1989

[54] HEAD STRUCTURE FOR GOLD CLUBS

[75] Inventor: Kenji Kobayashi, Niigata, Japan

[73] Assignee: Endo Manufacturing Co., Ltd, Japan

[21] Appl. No.: 156,726

[22] Filed: Feb. 17, 1988

[51] Int. Cl.[4] ..... A63B 53/04

[52] U.S. Cl. ..... 273/169; 273/167 F

[58] Field of Search ..... 273/169, 167 F

[56] References Cited

U.S. PATENT DOCUMENTS

| | | | |
|---|---|---|---|
| 922,444 | 5/1909 | Youds | 273/169 |
| 1,452,845 | 4/1923 | Pryde | 273/169 |
| 1,968,627 | 7/1934 | Young | 273/169 |
| 3,814,437 | 6/1974 | Winquist | 273/167 F |
| 3,995,865 | 12/1976 | Cochran et al. | 273/167 |

*Primary Examiner*—Edward M. Coven
*Assistant Examiner*—Benjamin Layno
*Attorney, Agent, or Firm*—Steele, Gould & Fried

[57] ABSTRACT

A head structure for a golf club, has a head body having a face for providing a ball hitting surface and a balancing weight made denser than the head body which is press-fitted so firmly on the head body that it may not come out. The press-fitting is accomplished by a combination of dovetail joint or the like. The dovetail joint includes a fitting mortise flaring towards its bottom and extending longitudinally of one of the head body and the balancing weight, and a corresponding fitting tenon flaring to have a width diminishing towards its root and extending longitudinally of the other so that it may be firmly fitted in the mortise.

1 Claim, 5 Drawing Sheets

HEAD STRUCTURE FOR GOLD CLUBS

BACKGROUND OF THE INVENTION

1. Field of the Invention

The present invention relates to a golf club and, more particularly, to an improved structure of the head of the golf club having a balancing weight.

2. Description of the Prior Art

One head of the golf club of this type according to the prior art is disclosed in U.S. Pat. No. 3,995,865. The clubhead disclosed has its front side formed with a face providing a ball hitting surface and its back fitting a balance weight of tungsten or the like therein. The clubhead is further formed at its one with side a hosel or neck at which it is connected to a shaft.

When the player makes a swing, an intense centrifugal force is exerted upon the clubhead. This requires strict firmness in fixing the balancing weight in the clubhead. The reason for this strict firmness is that if the balancing weight should come out of the head when the golf club is swung the shot could never be accurate. Still the worse, the balancing weight might fly to hit another person accidentally.

A number of devices have been conceived to eliminate the possibility of allowing the balancing weight to fly off when the club is swung, but this possibility cannot be cleared with the fixing technique of the prior art.

SUMMARY OF THE INVENTION

It is, therefore, an object of the present invention to provide an improved structure of the head of a golf club having a balancing weight fixed so firmly that it never flies off when the golf club is swung.

According to a major feature of the present invention, there is provided a head structure for a golf club, comprising: a head body having a face for providing a ball hitting surface; a balancing weight made denser than said head body; and means for press fitting said balancing weight so firmly on said head body that it may not come out.

BRIEF DESCRIPTION OF THE DRAWINGS

Other objects, features and advantages of the present invention will become apparent from the following description taken with reference to the accompanying drawings, in which.

DESCRIPTION OF THE PREFERRED EMBODIMENTS

Figure 1:
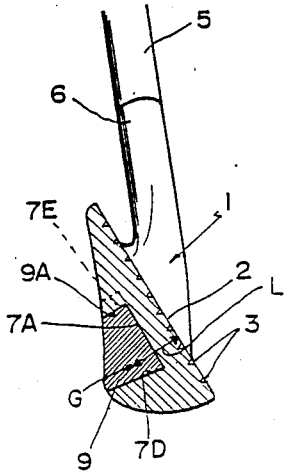
FIG. 1 is a section showing a structure of a clubhead according to a first embodiment of the present invention.
Figure 2:
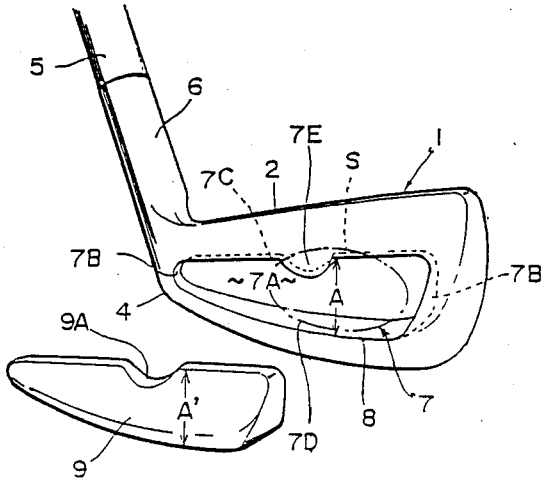
FIG. 2 is an exploded perspective view showing the clubhead structure of the first embodiment.
Figure 3:
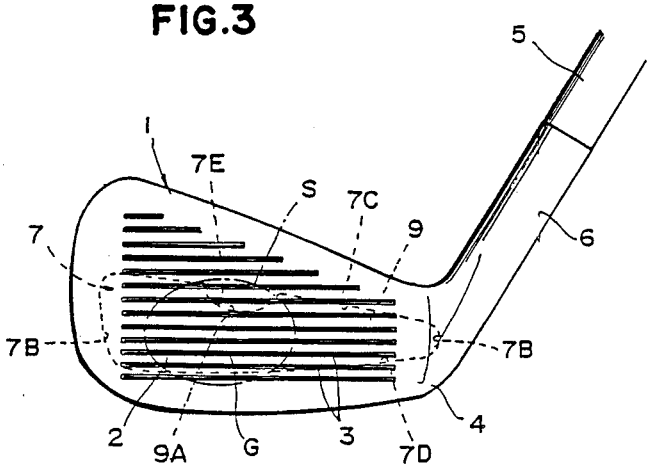
FIG. 3 is a front elevation of the first embodiment.
Figure 4:
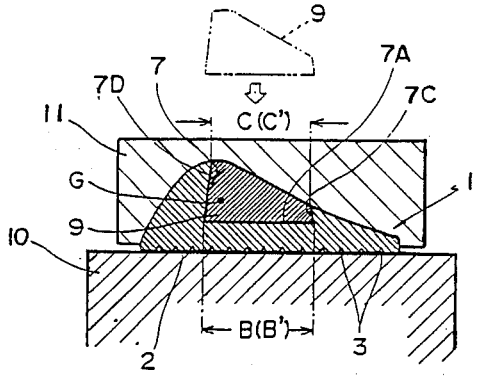
FIG. 4 is a section showing a press-fitting step for manufacturing the first embodiment shown in FIGS. 1 to 3.

FIGS. 1 to 4 showing a head structure of a golf club according to the first embodiment of the present invention. A clubhead structure, as generally designated at 1 in FIGS. 1 to 4, is die-cast or forged of steel. The clubhead 1 has a face section 2 formed with horizontal parallel grooves 3 and providing a ball hitting surface. From a heel 4 of the head 1, there extends slightly obliquely upward a hose or neck 6 for mounting a club shaft 5 therein. The back of the head 1 is formed with a generally horizontal groove 7 acting as a fitting recess or mortise. This fitting groove 7 is defined by a bottom wall 7A, side walls 7B and upper and lower walls 7C and 7D. The upper wall 7C is projected at its center to form a bulge 7E. The fitting groove 7 thus formed has a width A diminishing gradually toward the heel 4, as better seen from Fig. 2, and its upper and lower walls 7C and 7D tapered, as better seen from FIG. 4, such that a bottom width B taken at the bottom wall 7A is larger than a mouth width C taken at the mouth 8 of the fitting groove 7 (that is, $B>C$).

A balancing weight 9 is provided for adjusting the center of mass (i.e., centroid) G and sweet spot S of the clubhead 1. This balancing weight 9 is also diecast or forged of a material having a larger specific weight than that of the clubhead 1 such as brass or lead. The balancing weight 9 has its own centroid G displaced downward and has a slightly larger width than that of the aforementioned fitting groove 7. Specifically, the balancing weight 9 is fitted within its elastically deformable range and has its centroid dropped by forming a retaining recess 9A generally at the center of its upper portion for preventing it from coming out. Moreover, the balancing weight 9 has such a trapezoidal or dovetail-shaped section acting as a flaring tenon that its width diminishes from B' corresponding to the bottom width B of the fitting groove 7 towards its root width C' corresponding to the mouth width of the groove 7 (that is, $B'>C'$).

The fixing process of the balancing weight 9 thus constructed in the clubhead 1 will be described in the following. First of all, the fitting groove 7 is formed in the back of the clubhead 1. After this, this clubhead 1 is placed on a bed 10. Then, the balancing weight 9 is press-fitted under a pressure of several ten thousands tons in the fitting groove 7 of the clubhead 1 by the cope or upper half of mold 11 of a press. The balancing weight 9 thus fitted integrally in the clubhead 1 is polished to a final product.

By this process, the balancing weight 9 can be firmly fixed in the back of the clubhead 1. Here, the fitting groove 7 in the clubhead 1 is formed into the dovetail shape having a width increasing towards the bottom (i.e., $B>C$). On the other hand, the balancing weight 9 is similar to but slightly larger than the fitting groove 7 so that it can be prevented from coming out. Thus, the balancing weight 9 can be fixed in the press-fitted manner.

Since, moreover, the balancing weight 9 is formed with the retaining recess 9A at its central portion, its centroid G can be set at a lower position. As a result, the centroidal depth L, i.e, the distance from the face section 2 to the centroid G can be enlarged to width the area of the sweet spot S. The location of the retaining recess 9A generally at the center of the balancing weight 9 can distribute the weight balance longitudinally of the clubhead 1 to elongate the sweet spot S.

Still moreover, the clubhead 1 is made of steel whereas the balancing weight 9 is made of brass or lead. By combining these two kinds of metallic materials, there can be exhibited an effect that the location of the centroid G and the sweet spot S can be freely set.

In FIGS. 5 to 10 showing clubhead structures according to second to sixth embodiments of the present invention, the same portions as those of the foregoing first embodiment are designated at the common reference numerals, and their repeated detail descriptions will be omitted.

Figure 5:
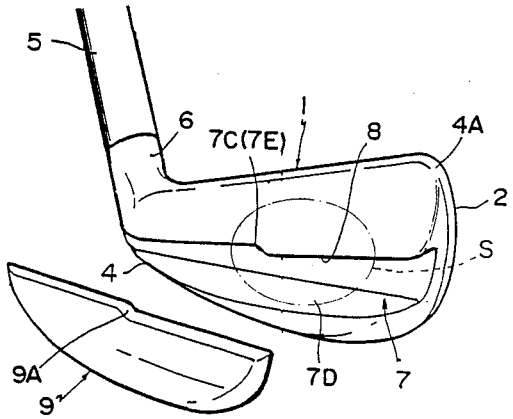
FIG. 5 is an exploded perspective view showing a clubhead structure according to a second embodiment.

In the second embodiment shown in FIG. 5, the fitting groove 7 is formed in the clubhead 1 to extend longitudinally from the heel 4 to the toe 4A of the clubhead 1. The upper wall 7C of the groove 7 is stepped, as indicated at numeral 7E, and the balancing weight 9 is formed with a corresponding stepped portion 9A for engagement with the stepped portion 7E.

Since the balancing weight 9 is thus arranged from the heel 4 to the toe 4A, the sweet spot S can be elongated.

Figure 6:
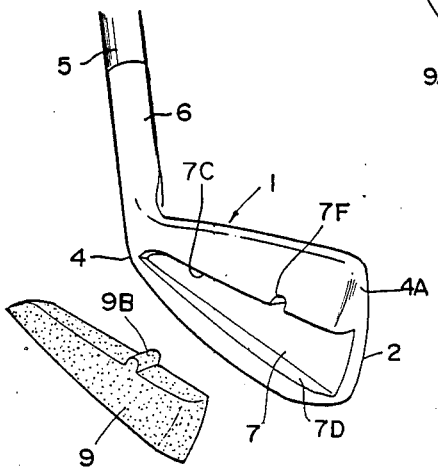
FIG. 6 is similar to FIG. 5 but shows a clubhead structure according to a third embodiment.

In the third embodiment shown in FIG. 6, the fitting groove 7 is formed in the back of the clubhead 1 to have a width increasing towards the toe 4A. The fitting groove 7 is formed in its upper wall 7C with a retaining recess 7F. In this retaining recess 7F, there is retaining the ridge 9B which is formed on the balancing weight 9 to be press-fitted in the fitting groove 7. Thus, the sweet spot S can be displaced towards the toe 4A by widening the groove 7 gradually towards the toe 4A.

Figure 7:
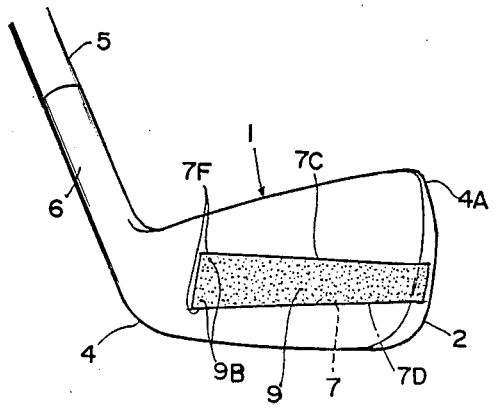
FIG. 7 is a perspective view showing a clubhead structure according to a fourth embodiment.

In the fourth embodiment shown in FIG. 7, the fitting groove 7 in the back of the clubhead 1 is formed with the recesses 7F to have a width increasing towards the heel 4. In this groove 7 thus formed, there is press-fitted the balancing weight 9 which has the bulges 9B. Since the balancing weight 9 is press fitted in the groove 7 having its width diminishing gradually towards the toe 4A, it can be prevented from coming out by the tapered upper and lower walls 7C and 7D even if it receives the centrifugal force when the golf club is swung.

Figure 8:
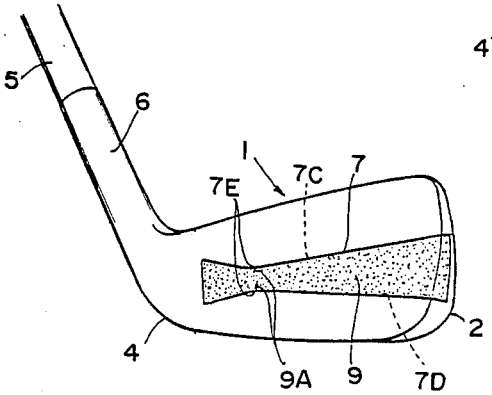
FIG. 8 is similar to FIG. 7 but shows a fifth embodiment.

In the fifth embodiment shown in FIG. 8, two vertical bulges 7E are formed on the upper and lower walls 7C and 7D of the fitting groove 7 in the back of the clubhead 1. The balancing weight 9 is formed with the corresponding recesses 9A and fitted in that groove 7. Thus, the bulges 7E formed on the upper and lower walls 7C and 7D of the groove 7 can with stand the centrifugal force of the swing with their engagement with the recesses 9A.

Figure 9:
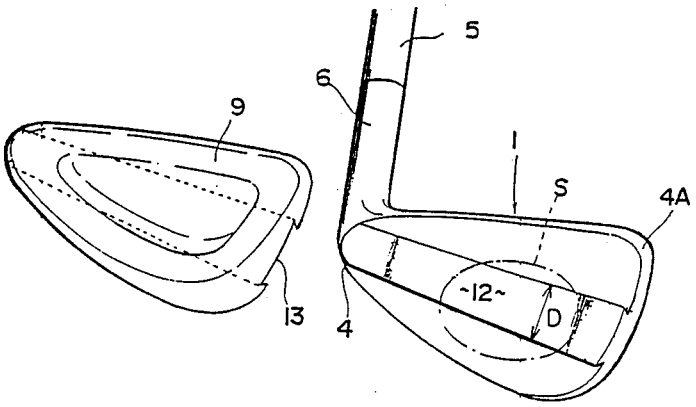
FIG. 9 is an exploded perspective view showing a clubhead structure according to a sixth embodiment.
Figure 10:
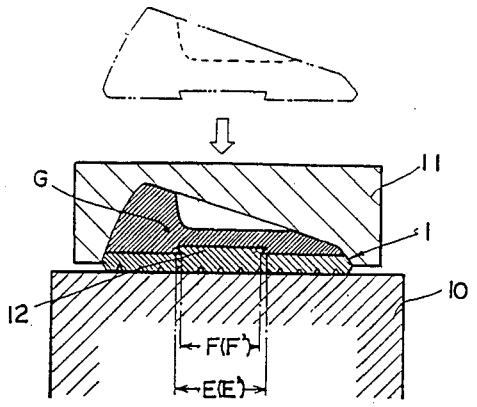
FIG. 10 is a section showing a press-fitting step for manufacturing the sixth embodiment shown in FIG. 9.

In the sixth embodiment shown in FIGS. 9 and 10, the clubhead 1 is formed on its back with a flaring bulge or tenon 12 which extends longitudinally thereof from the heel 4 to the toe 4A. As seen from FIG. 9, the bulge 12 has its width D increasing towards the toe 4A. Correspondingly, the balancing weight 9 is formed in the opposed side with a fitting groove 13 acting as a mortise for fitting the flaring bulge 12. Thus, the clubhead 1 is manufactured, after it has been placed on the bed 10, by press-fitting the balancing weight 9 under several thousands tons by the cope or upper half of mold 11 to form an integral structure. In other words, the dovetail joint is effected between the tenon 12 and the mortise 13. In the fitted state, as better seen from FIG. 10, the root width E of the tenon 12 is equal to the bottom width E' of the mortise 13, and the top width F of the tenon 12 is equal to the mouth width F' of the mortise 13. Thus, the balancing weight 9 can be fixed on the whole back of the clubhead 1 by the press-fitting in the dovetail joint.

Figure 11:
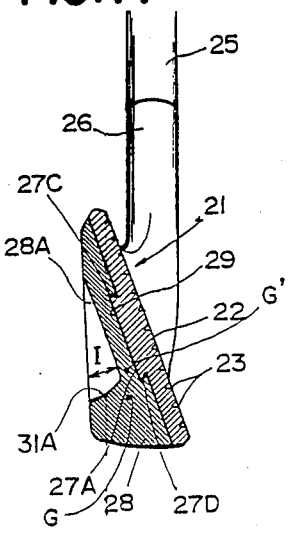
FIG. 11 is a section showing a clubhead structure according to a seventh embodiment.
Figure 12:
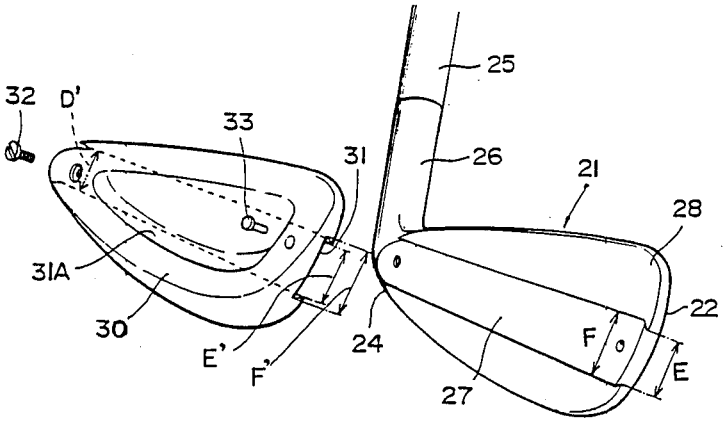
FIG. 12 is an exploded perspective view of the seventh embodiment.

In the seventh embodiment shown in FIGS. 11 and 12, the clubhead 1 is made of a hard synthetic resin. This clubhead 21 has a face section 22 formed with horizontal parallel grooves 23 and providing a ball hitting surface. From a heel 24 of the head 21, there extends slightly obliquely upward a hose or neck 26 for mounting a club shaft 25 therein. The back of the head 1 is formed with a generally horizontal bulge 27 acting as a fitting tenon. This fitting bulge 27 is shaped to have a root width E smaller than a top width F and to have an overall width increasing toward a toe 28.

A balancing weight 30 is fixed on the fitting tenon 27 to adjust the position of the centroid G' and the area of the sweet spot. This balancing weight 30 is die-cast or forged of brass. The balancing weight 30 thus manufactured is sized and shaped to cover the whole back of the clubhead 21. For the fitting purpose, the balancing weight 30 is formed with a fitting groove or mortise 31 to be fitted on the corresponding tenon 27. This groove 31 is shaped to have a bottom width $E'(\approx E)$ smaller than a mouth width $F'$ $(\approx F)$ and its overall width increasing from the heel 24 to the toe 28.

Thus, the fitting mortise 31 of the balancing weight 30 is inserted onto the fitting tenon 27 from the side of the heel 24, and the balancing weight 30 is fitted on the tenon 27 and fixed together by means of a screw 32 and a rivet 33. Reference numeral 31A designates a recess which is formed in the back of the balancing weight 30 for adjusting the balance.

With the structure thus made, when the golf club is swung, its head 21 and the balancing weight 30 are subjected to the centrifugal force at their portions near the toe 28. This centrifugal force will cause the balancing weight 30 to come out of the clubhead 21. However, the centrifugal force can be overcome by the retention which is established by the fitting tenon 27 having its width increasing towards the toe 28, thus preventing the balancing weight 30 from coming out. As a result, this dovetail joint can exhibit the function to prevent the balancing weight 30 from coming out against the centrifugal force. It should be noted here that this function is not followed by any local stress because of the face-to-face contact between the fitting tenon 27 and the corresponding mortise 31 of the balancing weight.

Moreover, the fixing operation of the balancing weight 30 on the clubhead 21 can be accomplished merely by inserting the weight 30 from the side of the heel 24 because the mortise 31 is narrower at the bottom E or E' than at the mouth F or F'.

Figure 13:
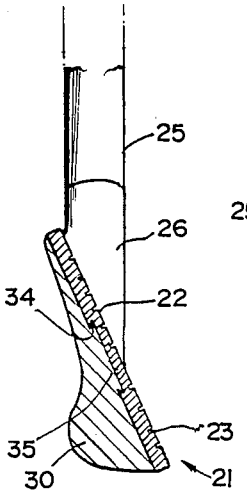
FIG. 13 is a section showing a clubhead structure according to an eighth embodiment.
Figure 14:
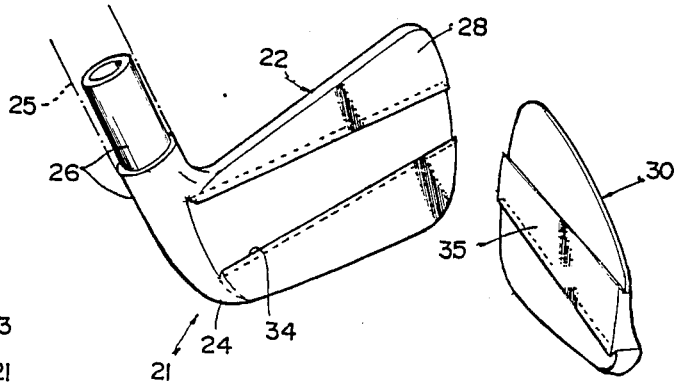
FIG. 14 is an exploded perspective view of the eighth embodiment.
Figure 15:
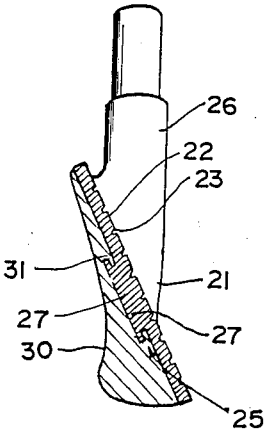
FIG. 15 is a section showing a clubhead structure according to a ninth embodiment.

Turning now to FIGS. 13 and 14, and 15 showing eighth and ninth embodiments of the present invention, the same portions as those of the foregoing seventh embodiment are designated at the common reference numerals, and their repeated detail descriptions will be omitted.

In the eighth embodiment shown in FIGS. 13 and 14, the clubhead 21 is formed in its back with a fitting groove or mortise 34 which is narrowed towards the toe 28, whereas the balancing weight 30 is formed thereon with a fitting tenon 35 which is to be fitted in the mortise 34. The balancing weight 30 thus constructed is integrated by inserting its tenon 35 into the mortise 34 of the clubhead 21 from the side of the heel 24. This eighth embodiment is advantageous in that the balancing weight 30 can be made denser with the tenon 35 to set a larger centroidal depth.

In the ninth embodiment shown in FIG. 15, the clubhead 1 is formed on its back with a land 27 which has its upper and lower edges recessed in the shape of letter "L" along its surface. A corresponding groove 31 is formed in the balancing weight 30 to have L shaped side walls and is fitted on the land 27 of the clubhead 21.

Incidentally, the present invention should not be limited to the embodiments thus far described but can be modified in the combinations of the materials for the clubhead and the balancing weight. For example, the head body may be made of aluminum or its alloy, titanium or its alloy, carbon, carbon fiber, glass fiber, a resin such as a carbon fiber reinforced resin, German silver, a beryllium-copper alloy, pure iron, stainless steel, ceramics or steel. On the other hand, the balancing weight is made of a denser material having a higher specific weight than that of the clubhead. The denser material to be selected may be iron, steel, copper or its alloy, molybdenum, tungsten or nickel.

Meanwhile, the present invention can also be applied to "woods", i.e., wooden clubs. In this modification, the materials may be combinations of woods of different densities or wood and metal.

What is claimed is:

1. A head structure for a golf club, comprising:

a head body having a face for providing a ball hitting surface;

a balancing weight made denser than said head body;

means for press-fitting said balancing weight so firmly on said head body that it may not come out, said means including a fitting mortise flaring towards its bottom and extending longitudinally of one of said head body and said balancing weight, and a corresponding fitting tenon flaring to have a width diminishing toward its root and extending longitudinally of the other so that it may be firmly fitted in said mortise, and wherein said fitting mortise and tenon are narrowed from the heel to the toe of said head body partly to retain said tenon in said mortise while preventing said balancing weight from coming out against the centrifugal force which is established when said golf club is swung and partly to displace the position of the overall centroid of said head structure toward said heel.

* * * * *